US006140921A

United States Patent [19]

Baron et al.

[11] Patent Number: 6,140,921

[45] Date of Patent: Oct. 31, 2000

[54] SEAT OCCUPANCY INDICATOR AND SEATING AREA DISPLAY SYSTEM

[76] Inventors: Herbert Eduard Baron, 14125 Ratcliff St., La Mirada, Calif. 90638; Russell Mistretta Abbott, 2616 Cross St., Riverside, Calif. 92503

[21] Appl. No.: 09/306,629

[22] Filed: May 7, 1999

[51] Int. Cl.[7] ..... G08B 21/00

[52] U.S. Cl. ..... 340/540; 340/573.1; 340/457

[58] Field of Search ..... 340/573.1, 457, 340/457.1, 540; 307/9.1, 10.1

[56] References Cited

U.S. PATENT DOCUMENTS

| | | | |
|---|---|---|---|
| 3,727,181 | 4/1973 | Robbins et al. | 340/457.1 |
| 3,859,485 | 1/1975 | Blinkilde et al. | 200/85 A |
| 5,032,834 | 7/1991 | Kane et al. | 340/825.28 |
| 5,168,451 | 12/1992 | Bolger | 364/436 |
| 5,612,876 | 3/1997 | Zeidler et al. | 364/424.055 |
| 5,797,126 | 8/1998 | Helbling et al. | 705/5 |

*Primary Examiner*—Nina Tong
*Attorney, Agent, or Firm*—Chris Papageorge

[57] ABSTRACT

An indicator and display system for theaters, auditoriums and the like provides information regarding occupancy on individual seats and a display providing information relating to seat occupancy and relating to the seating area. The system includes multi-colored lights mounted on the tops of the seats for indicating the occupancy thereof. The lights are controlled by sensors mounted in the seats and manual switches mounted on the seats. The system also includes a display panel located in the lobby or near the theater or auditorium which shows which seats are occupied and which are vacant. The display panel also numerically shows the seat availability and also shows in hologram form the seating arrangement and the location of restrooms, refreshment counter, etc. relative to the seating area as well as aisles and other information of use to the patrons.

27 Claims, 8 Drawing Sheets

SEAT OCCUPANCY INDICATOR AND SEATING AREA DISPLAY SYSTEM

BACKGROUND OF THE INVENTION

The invention relates generally to systems for visually providing information for patron use about a particular theater, auditorium or the like and, more particularly, to such a system which provides information regarding the occupancy status of the seats and information regarding the seating arrangement and the location of various artifacts that would be of use to the patrons of such establishments.

Patrons of theaters and the like have frequently been unable to find seating for viewing a show easily. Many establishments allows patrons to enter the seating area after the show has started and the seating area is relatively dark. A common experience of patrons entering the seating area at such times is that coming into a dark area after being outdoors in often bright sunlight means that the patrons are unable to discern vacant seats and must remain in the seating area standing and often blocking the view of seated patrons or simply being a distracting sight for seated patrons for such period of time as necessary until their eyes become acclimated to the darkness of the seating area. This can not only be an annoyance for seated patrons who have newly entering patrons standing around them but also an embarrassment to such newly entering patrons who may feel inadequate in dealing with the situation. There are frequently awkward moments for patrons in determining whether a seat is reserved or not. Patrons may attempt to reserve seats by substituting an object for a person on the seat or by barricading the seat. But, many people find it discomforting to nearly disrobe in order to leave a coat on the seat to create a substitute representation of occupancy, and this practice may also produce some anxiety that the coat, hat, etc. may become damaged by another attempting to mistakenly occupy the seat or stollen while the occupant has gone elsewhere. All this is done simply because the patrons may desire to leave their seat for the purpose of obtaining refreshments or for any number of other reasons before the show starts. In their eagerness to quickly secure seats, such newly entering patrons may attempt to sit in seats that may appear vacant but in fact are not either because the occupant is a child or the occupant has temporarily left the seat while reserving the same by leaving a coat or something like that on it that is too small to be sense from the aisle and in the dark. Some patrons attempt to avoid such mistakes by asking seated patrons if adjacent seats are taken. However, the many conversations often required for this are an important (undesired) distraction and often an annoyance to seated patrons who are attempting to listen to the show. Consequently, such situations detract from the enjoyment of the show by both newly entering and already seated patrons. In addition, this has the added detriment of compelling others to secure seats that are not desirable simply to avoid going through the questioning ritual.

Many establishment also believe it is necessary to show the patrons both where emergency exits are and where aisles and refreshment areas and restrooms are for the benefit of the patrons via different kinds of lighting schemes. Since this is typically the only way of informing seated patrons of the way to such areas and their location relative to the location of the seated patrons, such lighting schemes are often quite large and quite bright in order to assure the patrons clearly get such information. However, large bright signs and lights can produce undesired reflections in the theater screen which can interfere with the visibility thereof and can also make the entire seating area undesirably bright and thereby divert viewer attention from the screen or stage as well as detract from the discernability (required for optimum viewer enjoyment) otherwise provided by the lit stage or bright screen. enjoyment) otherwise provided by the lit stage or bright screen.

Some establishments employ ushers to personally show newly entering patrons the available seats and direct patrons to refreshment counters, restrooms, etc. However, employment of such additional personnel adds to the cost of operation of such establishments. In addition, the work required for such ushers is only at certain times during or prior to the performance. Consequently, at other times, these ushers do not have any related work to do but most likely have to be on the payroll nevertheless. In addition, such special personnel also adds undesired discourse, walking around, hand waving, using flashlights to show pathways and generally commotion which is often an important source of distraction or annoyance to other patrons. Also, such special personnel are often in the way of patrons who are walking in and through the seating area or adjacent areas.

Since theaters and auditoriums do not have the same layout of seating, refreshment counters and other artifacts related to the servicing the customers, patrons typically do not know how to find such things unless they have been to the theater before and remember. Consequently, new patrons typically have to walk around such establishment looking for what they require or find an employee to ask. This can not only be a time consuming venture but also sometimes a source of frustration for such patrons.

It is also a desired business practice to keep track of the location of customers and to keep track of the total number of occupied seats and thereby the total number of sales. This helps to inform newly arrived patrons if a performance is sold out and also helps management better keep track of up-to-date information on income generated by a performance.

Some prior art devices used to keep track of seat occupied or vacant information include a system of switches systems are not entirely accurate in the information provided because a sold theater seat would not necessarily be occupied until the show starts. Also, such systems do not inform the newly arrived patron which seats are vacant. In addition, such systems require an inordinately large amount of electrical wiring to accomplish the task and the wire routing may not be feasible in some types of establishments.

Simpler systems using written charts and lists are commonly used to keep records of patron seating. However, a primary disadvantage of such systems is the difficulty of continually changing a written chart with the result that often personal memory is substituted for the data included on such charts or for the entire chart. In addition, tying up an employee's time with visual observance of the patrons in the facility and keeping track of the whereabouts of the patrons adds to the expense of the business.

Some prior art systems have utilized electrical systems to provide seat occupancy status information. An example of such a system is disclosed in U.S. Pat. No. 5,032,834 to Kane. Kane describes theater seating systems but is specifically designed for restaurant tables. The Kane systems utilizes a plurality of hand held display panels which are wired to each other and simultaneously show the vacancy status of each table. However, a disadvantage of the Kane system is that the vacancy status is displayed only on the panel and not anywhere on the table or on the seats at the table. Thus, a patron must pick up the panel to determine whether or not tables are vacant and must discern and interpret the light scheme on the panel in order to determine which if any tables are vacant and their location relative to the particular panel viewed. In addition, such a display panel may not be available or convenient for the newly arrived patron. If such panels are not provided for direct patron usage but rather only a particular employee is assigned use of such panels, this may hinder or delay direct patron usage but rather only a particular employee is assigned use of such panels, this may hinder or delay providing the required vacancy information to the newly arrived patron if such employee is busy with other duties. Moreover, the special wiring required to interconnect the panels may be in the way of patrons and employees or may require inordinate expense to properly install.

Other prior art systems provide seating availability information and display other information regarding the seating environment. An example of such a system is disclosed in U.S. Pat. No. 5,797,126 to Helbling. The Helbling system is specifically designed for a theater and displays the view from particular seats as well as the layout of the seats and the interior of the facility. The system utilizes a display panel with touch screen capabilities and displays a scene exemplary of the particular event at the theater. However, the Helbling system does not have a provision for indicating seat vacancy on the seats per se. In addition, the Helbling system does not determine vacancy utilizing input directly from the seat occupant (or lack thereof) but rather utilizes seat availability information obtained via the ticket sales window. Thus, the information regarding seat occupancy provided by such systems may not be accurate since some patrons may leave the theater after buying the ticket but before the performance is over because they are dissatisfied with the performance or for any of a variety of other reasons. In addition, such systems are not able to reliably indicate exactly which seats are vacant and which are occupied.

Some prior art systems designed especially for automobile seats utilize sensors to determine seat occupancy thereof. Examples of such systems are disclosed in U.S. Pat. No. 5,612,876 to Zeidler and U.S. Pat. No. 3,859,485 to Blinkilde. The Blinkilde system uses a seat switch comprising a foam pad having electrically particles therein so that it is responsive to the pressure exerted thereon by the occupant. The Zeidler device also detects seat occupancy and utilizes a resistive membrane pressure sensor. The Zeidler device is specifically designed for use with an automobile airbag system. Neither of these devices include any system for displaying or indicating seat occupancy. Moreover, neither of these devices include any kind of visual display or indicator.

None of the prior art systems designed for facilities having an assemblage of seats provide the patron with an easy way of determining where the vacant seats are. Moreover, these prior art systems do not allow direct input into the seat occupancy determining means by the seat occupant at the site of the seat. Thus, these prior art systems do not obtain information regarding seat occupancy status directly from the seat occupants or the seats. In addition, none of these systems provide a realistic view of the seating area which includes selected visual information regarding the pathways, artifacts, and seating area layout in a readily understood and useable form while excluding other visual information deemed undesirable. Also, none of these prior art systems enable patrons to easily and effectively save their seats when they temporarily leave the seating area or to save seats for their companions.

SUMMARY OF THE INVENTION

It is a principal object of the present invention to provide a system which provides a visual indication of the seat occupancy status of individual seats in a seating area as well as a visual display of the entire seating area including the location of occupied and vacant seats and other visual information deemed useful to a user of the facility housing the seats.

It is another object of the present invention to provide a seat occupancy indicator system which is directly responsive to occupancy of the seat.

It is an object of the present invention to provide a seat occupancy indicator system which receives and is responsive to manual input from the occupant of the seat.

It is an object of the present invention to provide a seat occupancy indicator system which provides visual indication of the occupancy status on the seat at an easily viewed portion thereof.

It is an object of the present invention to provide a visual display system which shows seat occupancy status in response to input directly from structures at the seats.

It is also an object of the present invention to provide a seat occupancy indicator and area display system in which the electrical wiring thereof is routed alongwith electrical wiring used for other facets of the seating area in order to minimize installation costs and possible obstruction of pathways.

It is an object of the present invention to provide a seat occupancy indicator and area display system which uses a minimal amount of electrical wiring for interconnection of components thereof.

It is an object of the present invention to provide a seating area display system which provides a realistic three dimensional view of the seating area.

It is an object of the present invention to provide a seating area display system which provides a view of the seating area which excludes undesired details thereof in order to direct viewer attention to desired information relating thereto.

It is also an object of the present invention to provide a seating area display system the display panel of which is activated by a person coming within a selected distance therefrom.

It is also an object of the present invention to provide a seat occupancy indicator and area display system which allows the seat user to leave the seat while still retaining the occupied status thereof.

The system of the present invention is designed for use in a facility such as a theater, auditorium, airplane, bus, etc. which has an assemblage of seats whose vacancy status cannot be readily determined due to distance, lighting conditions or obstructed location relative to the viewing position. The system is specifically designed to provide useful and practical to a newly arrived patron of a facility having a number of seats enabling the patron to quickly find his way about the facility and find his way directly to the desired vacant seat. The information provided by the system is visual consisting of light on the seatback of the seat and a display panel at or near the entrance to the seating area. The information also may be of managerial use by enabling a determination of how many patrons actually viewed the show by comparison of seats sold and seats occupied. The information may also be of managerial use by enabling a determination of where patrons prefer to sit, which seats are occupied first and the rate patrons enter in relation to the commencement of the show.

Located at the entrance to the seating area of the theater or other facility, the display panel provides the patron with a realistic view of the seating area and the seating (with representation lighting having a suitable color scheme to identify the occupancy status) so that even before entering the seating area the patron would know where available seating is and can make a basic decision where to sit even before entering the seating area. The display panel would also provide a digital numerical read-out updating the remaining seats available. Thus, before entering the seating area, the patron would know how many seats are available coupLED with the generally realistic likeness of the theater seats. The display panel also may show other types of desired information such as advertisements or emergency type information such as location of fire exits, fire extinguishers, etc. Alternatively, the display panel may be situated outside the theater in order to advise potential patrons of the total seat vacancy, locations of vacant seats, etc.

Once inside the seating area, the system provides visual information of which particular seats are vacant and which are occupied via an indicator system of lights at each of the seats. The lights are located at the uppermost part of the seatback to allow viewing from the front and/or sides of the seat. Internal light sources allow identification through colors of the status of the seat i.e., either vacant or reserved. For occupied seats the lights are off so as not to disturb the patrons. By using different color combinations, the indicator lights can be used to divide the seating area into sections to provide faster transit to an empty seat. Preferably, red is used to indicate reserved while blue, green, yellow orange, amber and white are used to identify empty seats in other sections. When used in conjunction with the display panel view, the color scheme assists the patron in locating the seat they desire.

The indicator system includes a sensor to detect the presence of a seat occupant and a switch to allow the user to identify the seat as reserved for future occupation. The sensor is preferably either a thermal or pressure sensor located on the seatbottom. The switch is preferably a manual switch located at the armrest to provide quick user accessibility.

The sensor and manual switch are electrically connected to a control unit consisting of electric circuitry that is also electrically connected to the display panel for operational control thereof. This enables seat occupancy status to be immediately relayed to the display panel via the control unit thereby updating the occupancy status information provided by the display panel.

DETAILED DESCRIPTION OF THE PREFERRED EMBODIMENT

Figure 1:
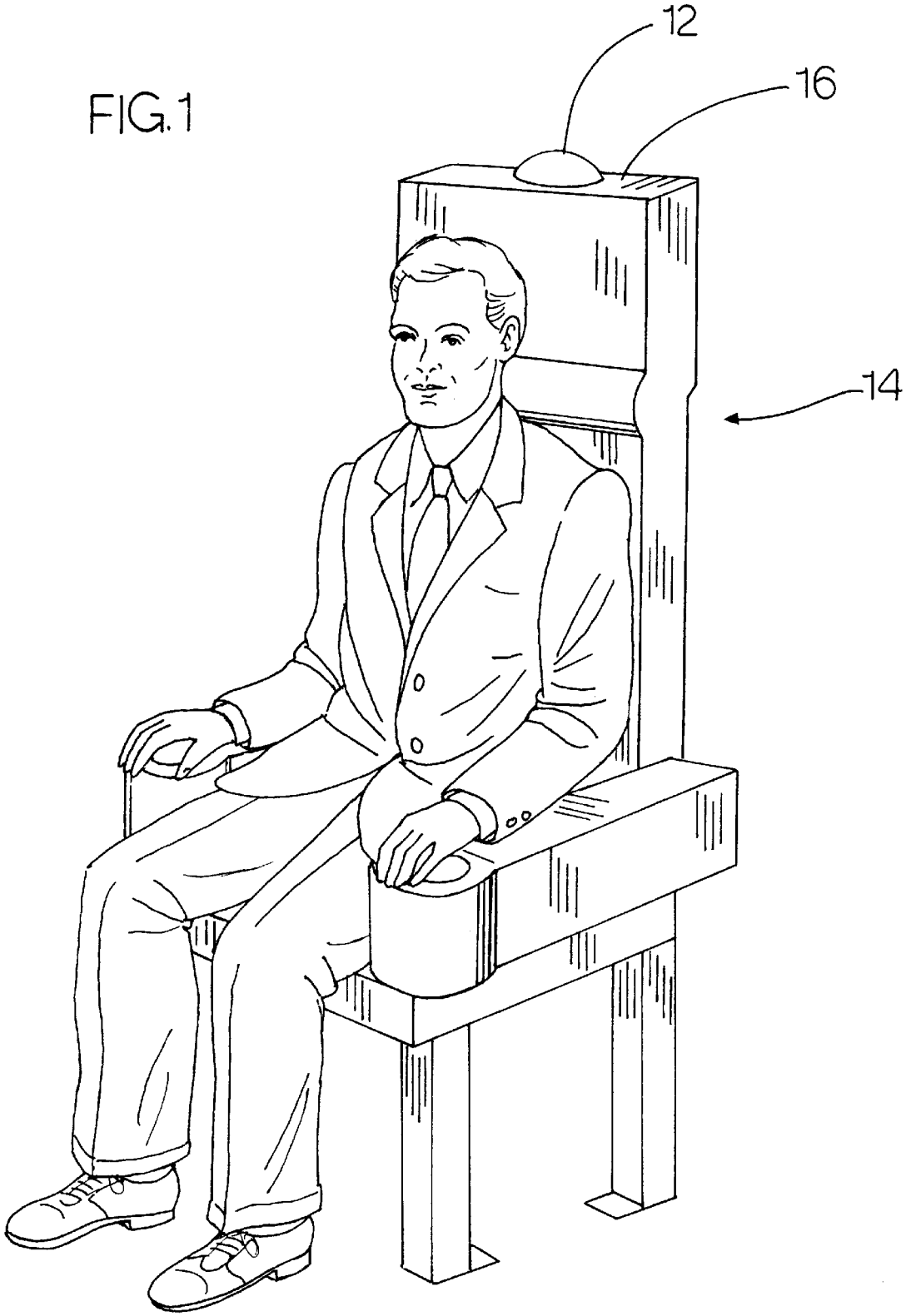
FIG. 1 is a perspective view of a representative seat showing a user seated thereon and showing an indicator light component of the system of the invention mounted at an upper portion of the seat for indicating seat occupancy status and showing a switch component of the system mounted on the armrest.
Figure 2:
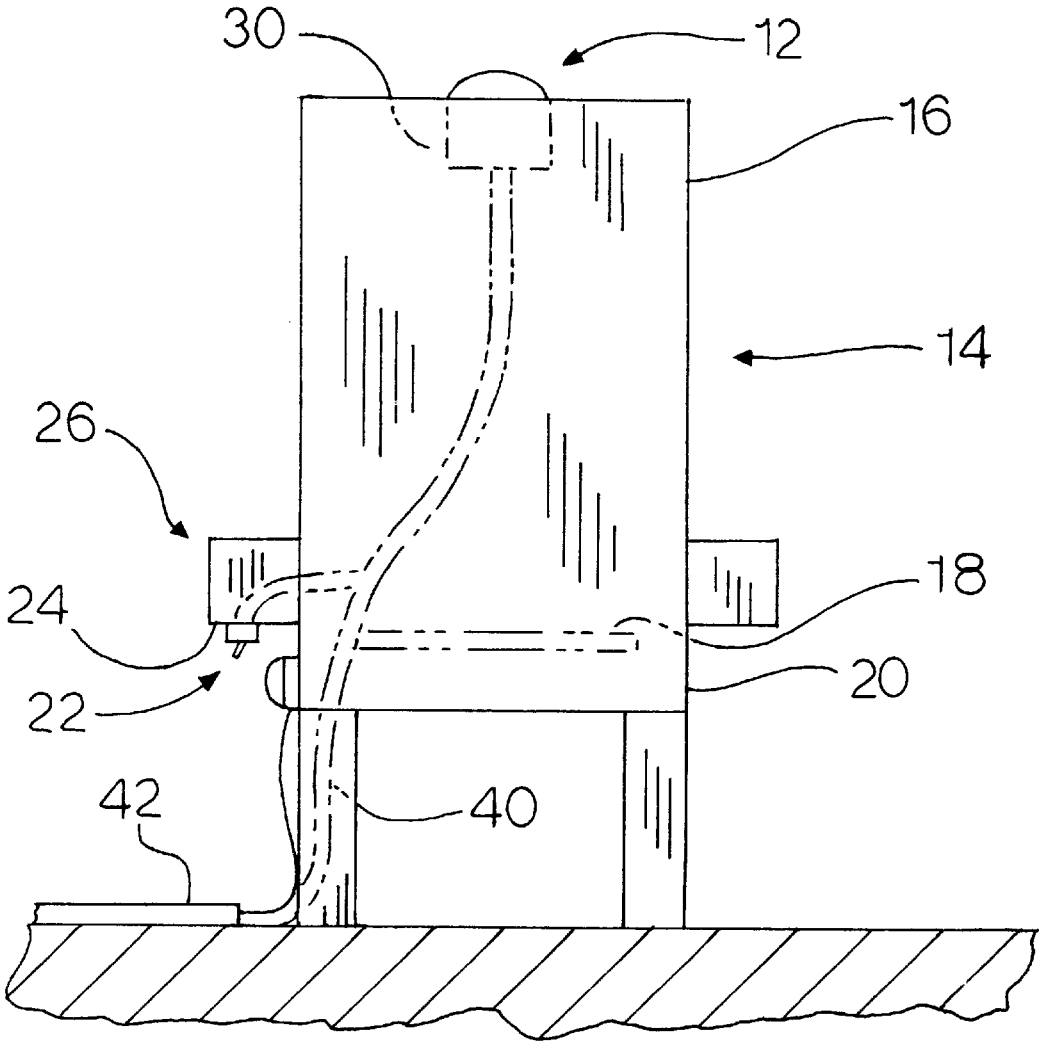
FIG. 2 is a rear isometric view of the seat of FIG. 1 showing the seat occupancy indicator system of the invention, the thermal sensor component thereof mounted within the seatbottom of the seat and the electrical wiring of the system routed within a wiring conduit of a conventional, preexisting seat row lighting system.
Figure 3:
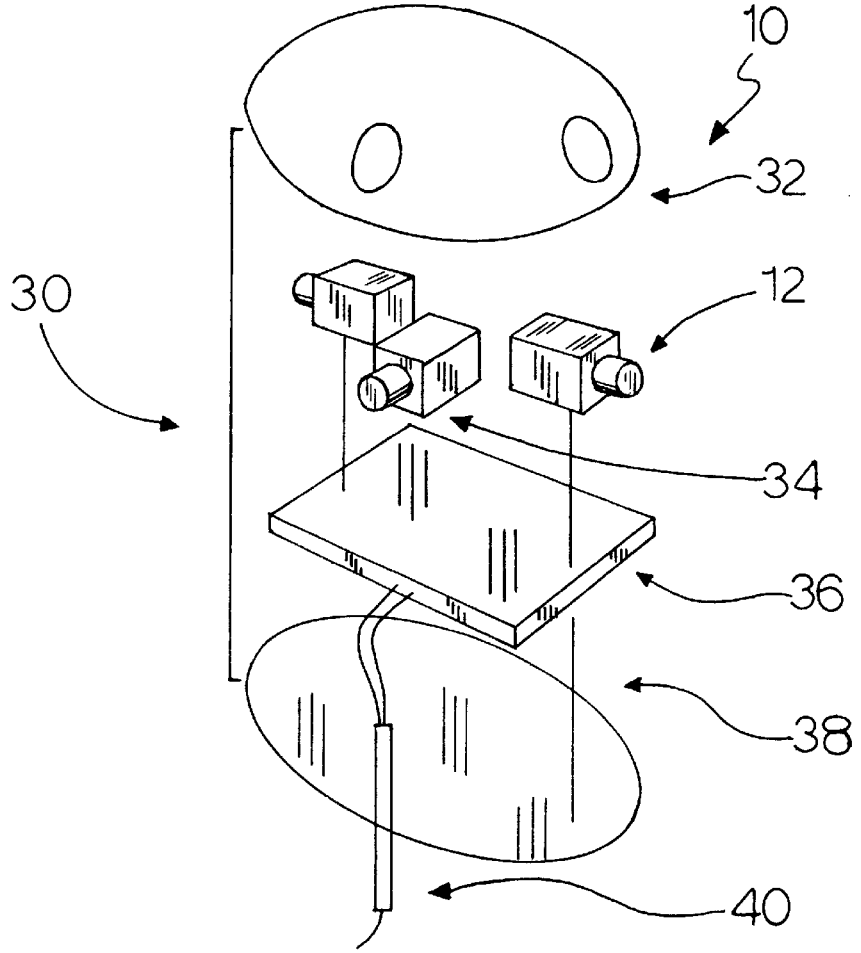
FIG. 3 is an exploded view of the seat occupancy indicator showing components thereof in detail.

Referring to the drawings, FIGS. 1, 2 and 3 show the seat occupancy indicator system of the invention generally designated by the numeral 10. The indicator system 10 includes a light 12 which is preferably electric and connected to a suitable power source (not shown). The light 12 is used to indicate to the observer whether or not the seat 14 is occupied. This is preferably accomplished by selection of light colors i.e., preferably red is selected to indicate that the seat is reserved (pragmatically occupied) and green indicates vacancy while no light emission indicates that the seat is occupied. In addition, other colors such as yellow, blue, amber, white are used in conduction with green to indicate the sectional location of the seat 14. The light 12 which is preferably an LED 12 is mounted at the top portion 14 of the seat 16. The light 12 is thus positioned at a location at which it is easily viewable from the sides and front of the seat 16 to facilitate observability thereof.

The light 12 is deactivated by a sensor 18 mounted within the seatbottom 20 of the seat 16, as shown in FIG. 2. The sensor 18 is preferably a pressure sensor 18 (or alternatively a thermal sensor 18) which is responsive to the pressure exerted by a user seated on the seat 16. The sensor 18 is electrically connected to the light 12. Thus, when a patron sits on the seat 16, the sensor 18 interrupts an electrical current to the light 12 turning off the light thereby indicating that the seat is occupied.

The system 10 also includes a manual switch 22 which is activated by the seat occupant to turn on the light 12 and, more specifically, to turn it on with a red color in order to indicate that the seat is reserved. This enables the seat occupant to leave the seat and go to the restroom, refreshment area while being assured that the seat will not be taken by another patron while he is gone. The manual switch 22 is preferably located at an underside portion 24 of the armrest 26 of the seat 14 to allow easy accesibility thereto while being out of the way of ordinary use of the armrest and not susceptible to being inadvertently or accidently activated by the seat occupant or by another patron. The switch 22 is preferably electrically connected to a timer 28 which deactivates the switch and turns off the light 12 after a predetermined period of time of light activation has elapsed. This prevents the light from indicating that the seat is reserved after the former occupant has been gone for such a long period of time that it may be concluded that he either has mistakenly activated the switch 22 or for another reason does not intend to return to the seat 16. Thus, the timer 28 prevents the light 12 from erroneously indicating that a seat is reserved.

The light indicator system 10 preferably includes a light unit 30 shown in FIG. 3. The light unit 30 is preferably mounted in the seatback 17 so that most of the unit is within the seatback except for the light emitting portion thereof which extends out of the seatback 17, as shown in FIG. 2. The light unit 30 includes the light (or LED) 12 which is more specifically a set of three lights oriented so that the light emitted therefrom shines in three directions which are mutually perpendicular so that the light shines outwardly from the seatback 17 toward the front and sides thereof. The light unit 30 also includes a transparent cover 32 mounted on the light 12 to protect it from dust, dirt, etc. The light unit 30 additionally includes a litepipe 34 which is mounted on the light 12 and utilized to direct light therefrom to the sides and front of the light unit (and thereby the seat 16) as shown in FIG. 3. A printed wiring board 36, which is mounted on a suitable base 38, is electrically connected to the light 12 for operation thereof. An electrical cable 40 is electrically connected to the wiring board for providing electrical power thereto via a suitable electrical power source (not shown) and for electrically connecting the switch 22 to the wiring board for deactivation of the light 12. In addition, the electrical cable 40 is preferably mounted within a conduit 42 which is also used for housing the electrical wiring used for conventional seat row lighting. This obviates the need for separate routing for the cable 40 of the invention thereby minimizing lumpy carpeting and the additional installation costs otherwise required for two separate cable systems.

Figure 4:
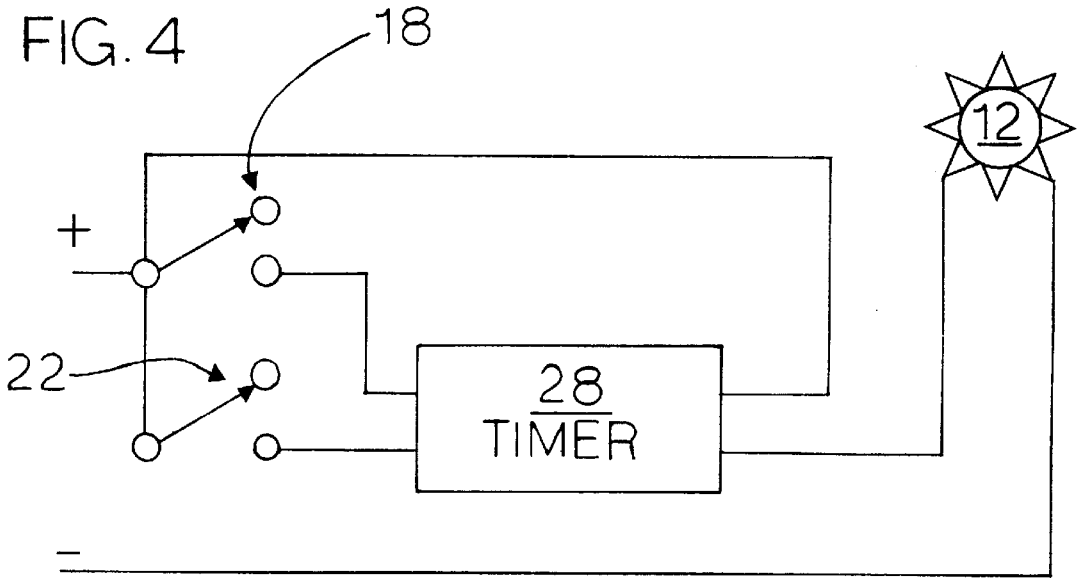
FIG. 4 is a schematic of the sensor, switch and timer components of the indicator system.

FIG. 4 shows the schematic for the sensor 18, manual switch 22, timer 28 and light 12. Essentially, the timer 28 acts as a type of override for the switch 22 by negating its activation after a predetermined period of time. The predetermined period of time is preferably ten minutes. However, other periods of time may also be selected if deemed suitable for the particular types of theaters, performance, or facility.

Figure 6A:
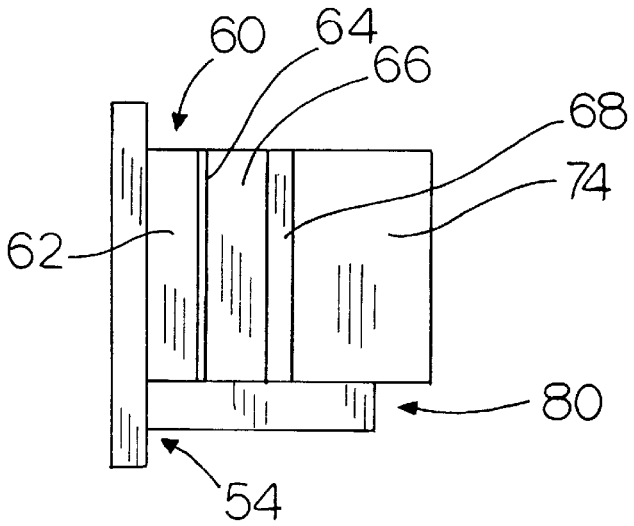
FIG. 6A is a side isometric view of the display panel showing components thereof.
Figure 6B:
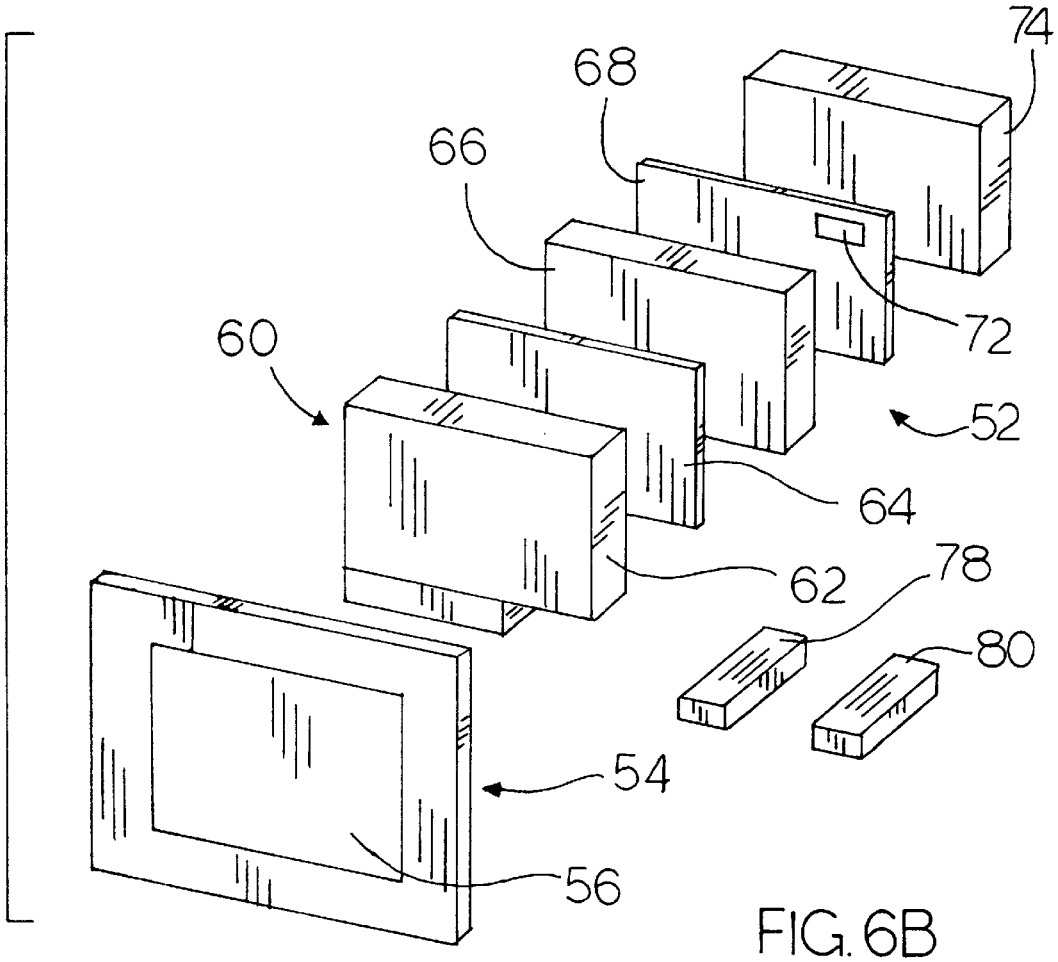
FIG. 6B is an exploded view of the display panel of the invention showing a detailled view of components thereof.

FIGS. 6A, 6B, 7A and 7B show the seating area display system of the invention generally designated by the numeral 50. As shown in FIG. 6A, the area display system 50 includes a display panel 52 having a front panel 54 having a screen 56 for displaying a preferably hologram view of the seating area 58. The display panel 52 also includes a clear panel 60 which is lit by edge lights 62. A holographic decal 64 is positioned behind the clear panel 60 and an opaque sheet 66 positioned behind the holographic decal enhances illumination of the decal for enhanced viewability of the holographic image provided thereby. The holographic decal 64 provides the desired view of the seating area 58, individual seats 14 and the other artifacts in the area as well as the layout of the seating area 58. The particular way in which the seats are depicted is selected to enhance viewer recognition of the layout of the seats and to facilitate viewer recongition of the location of the vacant seats. Although only one decal 64 is shown in the drawings, a plurality of such decals may be used to depict other areas in the theater that may be useful to the viewer or to depict advertisements, if desired. A display panel printed wiring board 68 is mounted behind the opaque sheet 66 and is provided with indicator lights (preferably LEDs) 70 as well as a seat counter display unit 72. A control unit 74 having electrical circuitry 76 is mounted behind the PWB 68. The display panel 52 also includes a thermal sensor 78 which activates the edge lights 62 in response to heat generated by a patron who approaches the display panel within a certain predetermined distance therefrom. However, other types of suitable proximity sensors may also be used, if desired. The display panel 52 also includes a power supply 80 for the edge lights 62. The thermal sensor 78 is electrically connected to the power supply 80 for activating the edge lights 62 via activation of the power supply 80. The thermal sensor 78 and power supply 80 are both preferably mounted underneath the clear panel 60.

Figure 7A:
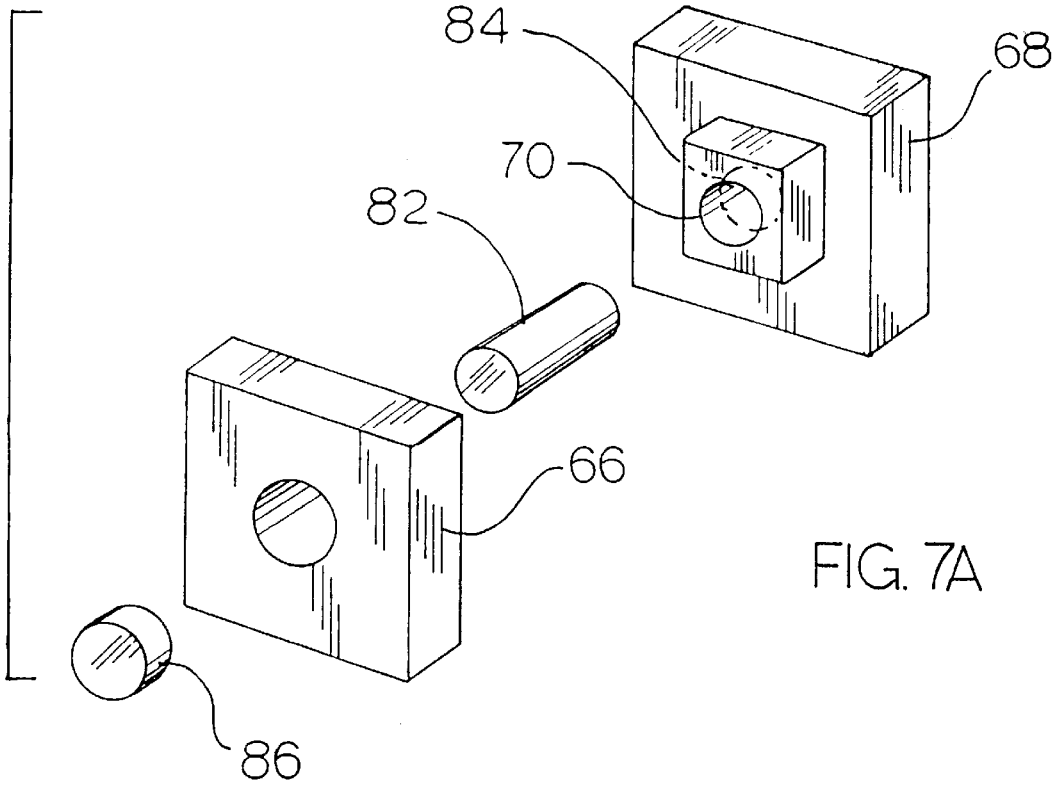
FIG. 7A is an exploded view of a portion of the display panel showing the printed wiring board thereof and related components.
Figure 7B:
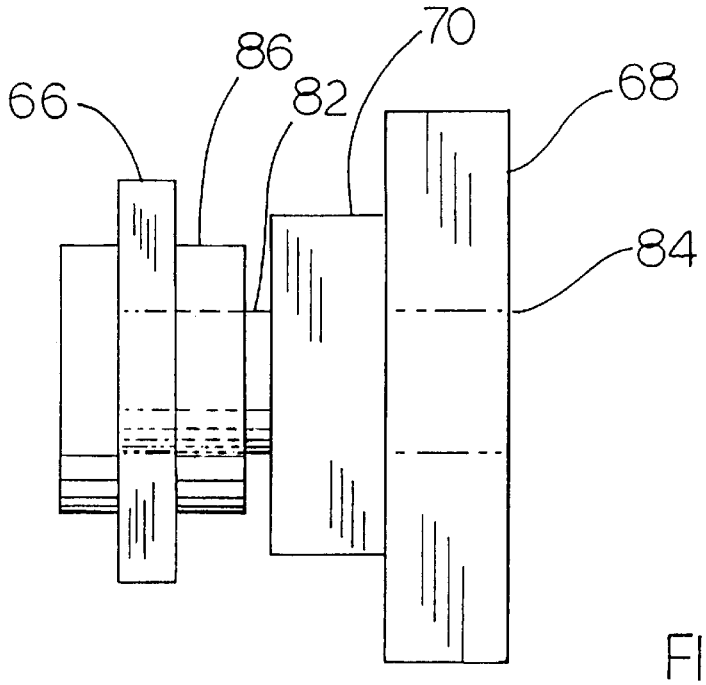
FIG. 7B is a side view of the components shown in FIG. 7A.

FIGS. 7A and 7B show the components of the display panel 52 which specifically provide the lights 70 of the image of the display panel 52 showing the seat occupancy status of the seats of the seating area. The lights (LEDs) 70 are located in that part of the image which depicts the individual seats 14 so as to identify the occupancy status of each individual seat. The LEDs 70 are preferably mounted on the printed wiring board 68 and a litepipe 82 is mounted in front of the LED and is used to direct light outwardly i.e., normal to the printed wiring board 68, from the board 68. Apertures 84 provided in the opaque sheet 66 receive the litepipe 82 and a lens 86 mounted in front of the litepipe 82 provides a desired cone of illumination provided by the LED 70. The apertures 84 are located so that in conjunction with use of the holographic decal showing the seats in the assemblage of seats, the lights are located in the seats in the holographic image provided so that the LEDs and the view of the seating area provide the desired visual information showing which seats are occupied and which seats are vacant. Thus, the apertures match up with the location of the seats in the holographic image. A numerical counter 72 is also mounted on the printed wiring board 68 and displays in numerical form the total number of seats vacant in response to data received from the indicator system 10.

Figure 5:
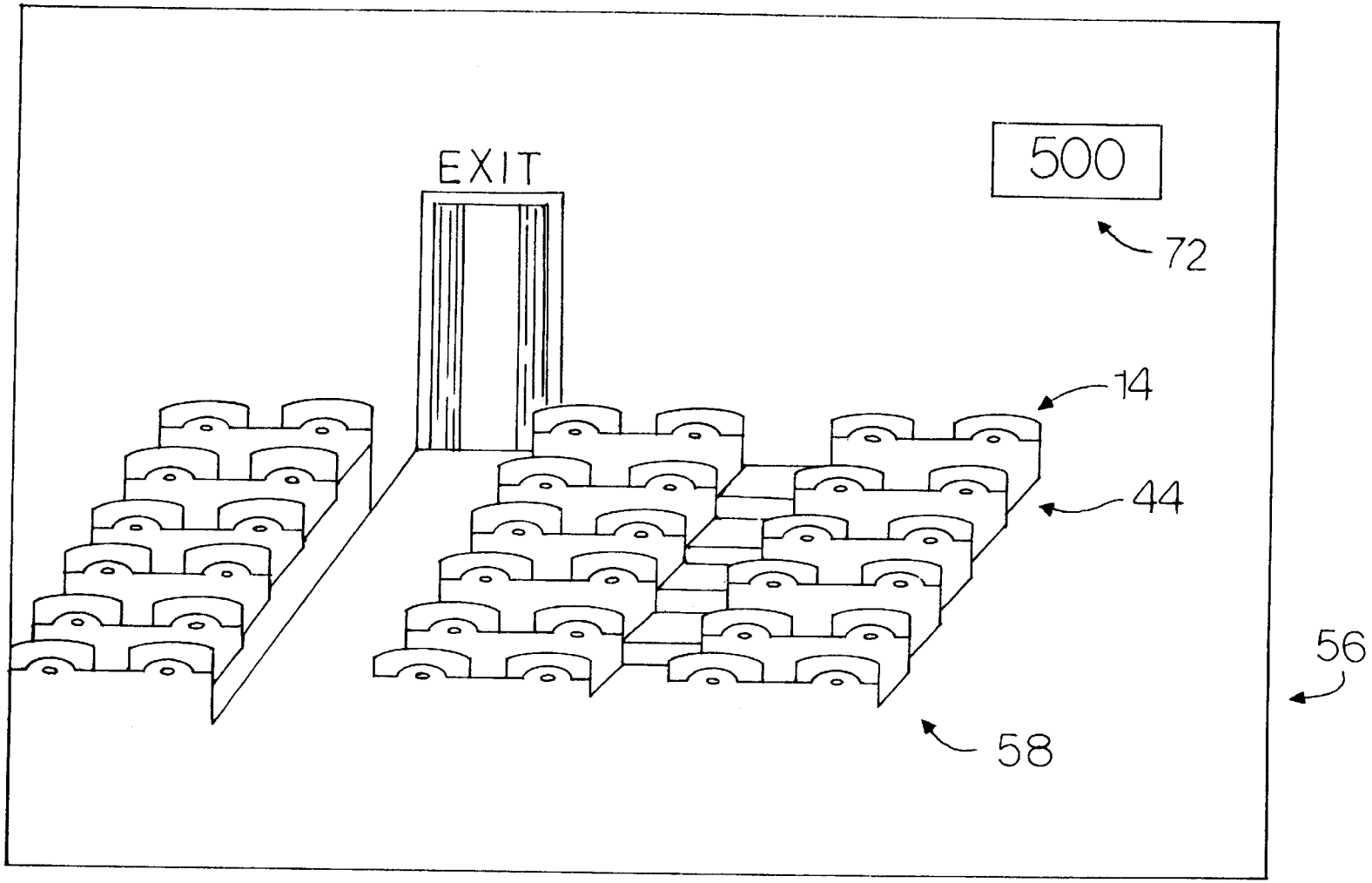
FIG. 5 is a front view of the display panel screen of the system of the invention displaying an image which is an exemplary view of a portion of a representative seating area.

FIG. 5 shows an exemplary view in holographic form provided by the display panel 52. The holographic image provided by the holographic decal 64 is a generally realistic view of the seating area showing the seat layout as well as the aisles thereof and their locations relative to each other. The vantage point of the image is preferably that deemed most likely to assist the newly arrived patron in getting a good understanding of the seating layout of the seating area and quickly finding the desired seat. Preferably the vantage point selected is that from an entrance to the seating area except at a higher elevation therefrom in order to provide better separation of the seats and artifacts in the seating area thereby providing a more comprehensive view of the area with better perspective such that the individual seats stand out from each other and from other artifacts in the area. The image may include the entire assemblage 44 of seats 14 or simply only a desired portion of the assemblage 44, as shown in FIG. 5. In addition, the image provided selectively includes some artifacts in the seating area while excluding others in order to provide the details deemed preferably included to provide the needed information while excluding other details deemed not providing needed information. Thus, the image excludes details deemed likely to confuse the viewer with unnecessary information. Moreover, the image includes details likely to provide necessary information and likely to help the viewer quickly turn his attention to what he needs to know. The exemplary view of FIG. 5 thus shows the seats 14 in general form but does not show the fabric thereof i.e., does not show the textural details of the seats. In addition, the image shows the aisles but does not show the carpeting in the aisles. Also, the image includes the exit signs and the exit doorways as well as the drapery covering the doorways but does not include the light fixtures for the rows of seats nor the light fixtures for the walls in the seating area. Moreover, the image excludes the artwork, sculptures, and structural features of the walls and ceiling which would otherwise tend to detract from the viewer's attention to desired information. In this way, the image allows the viewer to quickly focus his attention on the information sought. In order to provide information regarding seat occupancy and vacancy, the image includes lights at individual images of the seats which indicate the status thereof. No light for a particular seat indicates occupancy, red light for a seat indicates reserved status and lights of other colors such as green, amber, white, blue, yellow and orange identify particular sections of the seating area in order to direct the viewer more quickly and accurately to the desired general location of the desired seat and also to inform the viewer which sections have the most vacancies and where they are located to enable groups of patrons to more quickly select the appropriate seating areas which can best accomodate the entire group.

Figure 8:
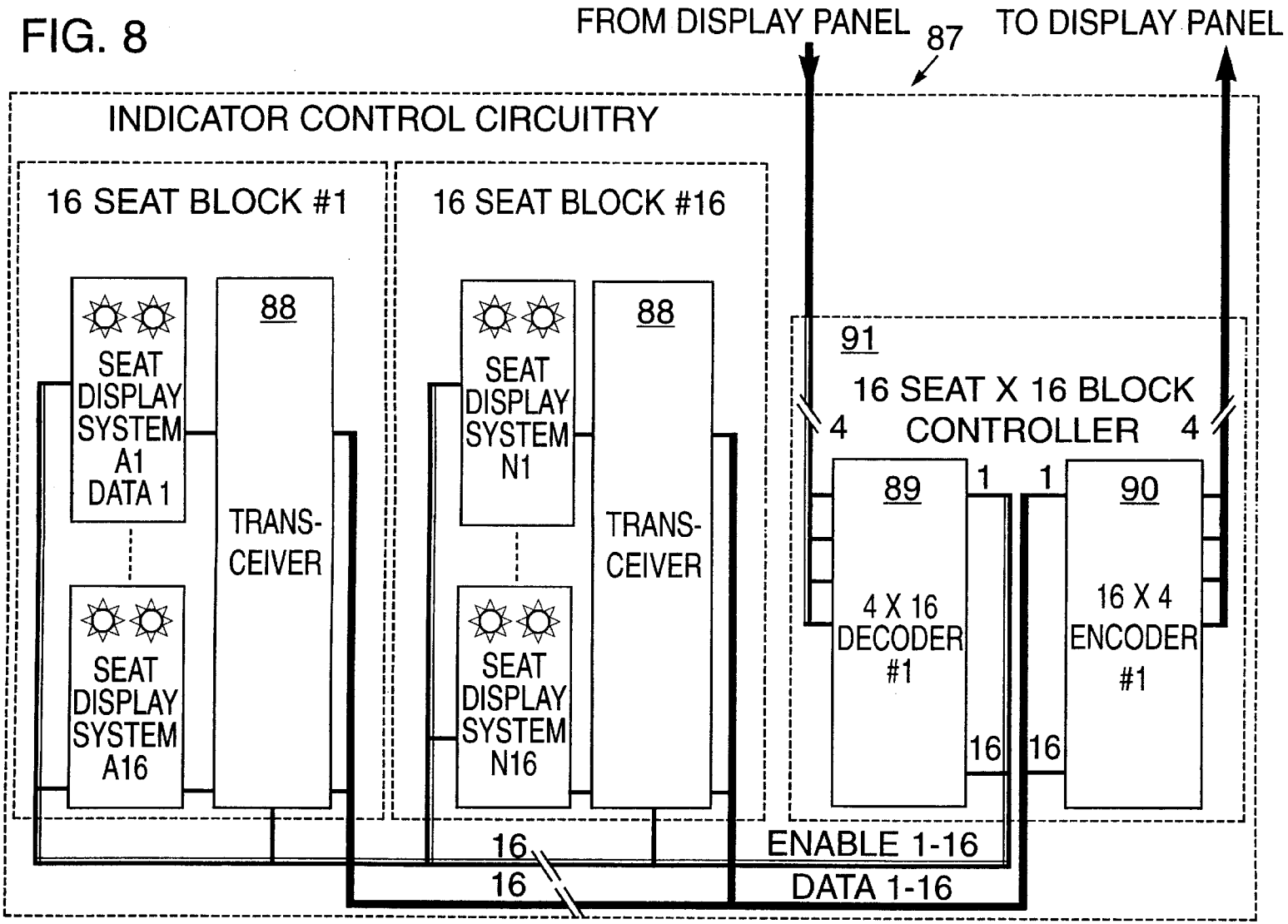
FIG. 8 is a block schematic diagram of the seat occupancy indictor system of the invention.
Figure 9:
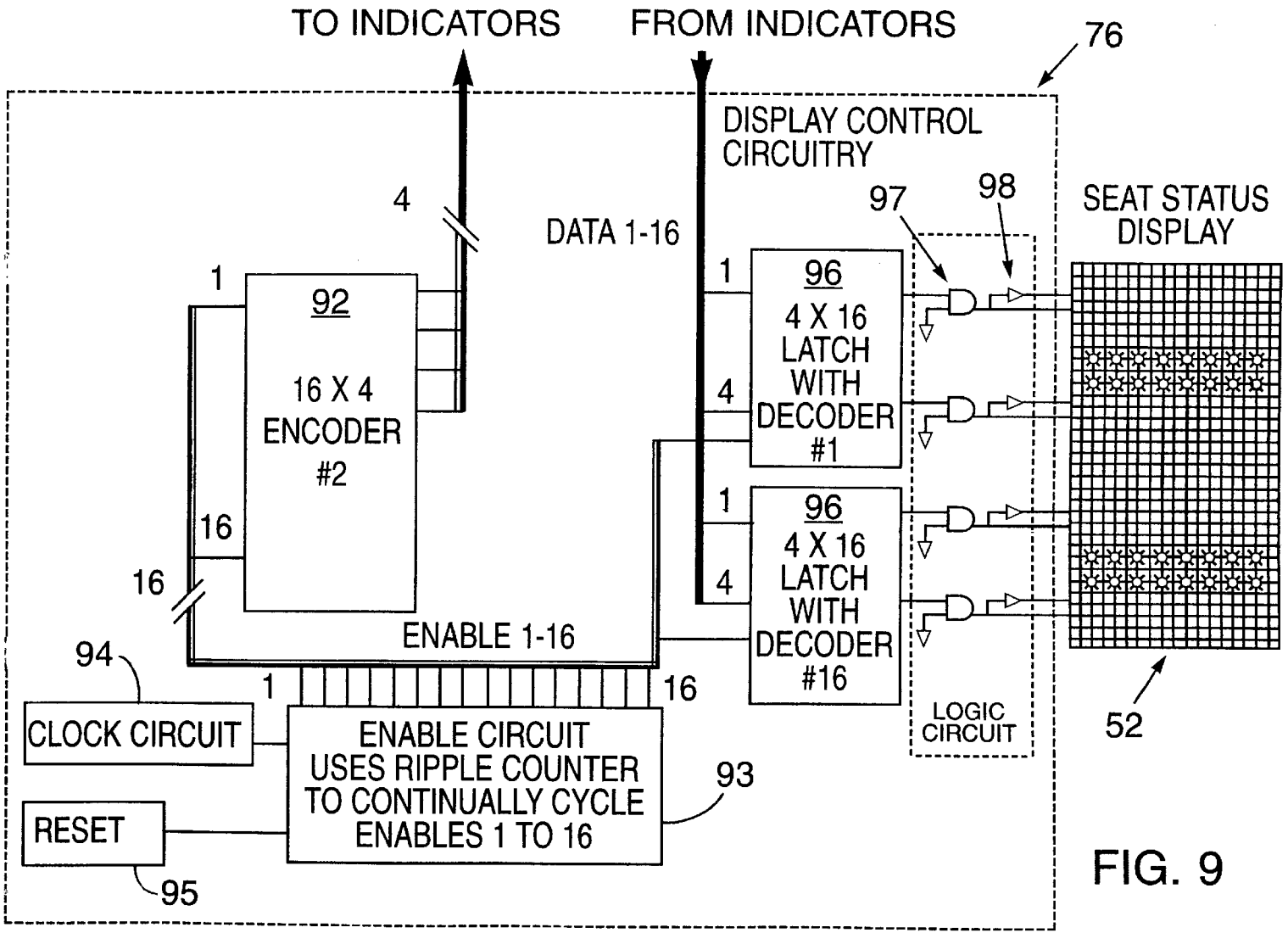
FIG. 9 is a block schematic diagram of the display panel system of the invention.

FIGS. 8 and 9 show the schematics in block form for both the occupancy indicator system 10 and the display panel system 50. FIG. 8 shows the indicator electric control circuitry 87 which is for a seat assemblage having sixteen seats per row and sixteen rows. However, more or less than this number may be used, if desired. Indicator electric control circuitry 87 is preferably on printed wiring board 36. Block number 1 is for a first row of seats while block number 16 is for a last row of seats. However, blocks number 1 and 16 are representative of the total rows of seats in the seat assemblage; all the rows of seats are preferably included in the system 10. In addition, block number 1 has seats A1 through A16 while block number 16 similarly has seats N1 through N16. However, these individual seats are representative of the total seats in the seat assemblage; all the seats are preferably included in the blocks and in the system 10. For each block, a transceiver 88 receives an enable signal from decoder number 89 polling the block of blocks 1 through 16. The transceiver 88 is preferably an octal-three-state noninverting transceiver for two way asynchronous communication between data buses. The response from each block is fed to an encoder number 90 which multiplexes the encoder lines into four wires to reduce the number of wires utilized in system 10. The decoder 89 demultiplexes the enable lines into sixteen lines with each enable line going to a particular seat block. Decoder 89 and encoder 90 are preferably included in block controller 91.

FIG. 9 shows the display electric control circuitry 76 which is specifically for the display panel 52 but which also works in conjunction with the indicator electric control circuitry 87. Circuitry 76 is contained in control unit 74 and includes an encoder 92 which multiplexes the encoder lines into four wires and feeds the signal to the decoder 89 of the indicator control circuitry 87. The encoder 92 receives a signal from an enable circuit 93 which is connected to and receives signals from a clock circuit 94 and reset circuit 95. The signal received from the seat blocks 1 and 16 in response to polling by the enable circuit 93 is received by latches with decoders 96 and transmitted to logic circuits comprising AND gates and NOR gates 97 and 98. The resulting signal is fed to the numerical counter 72 and to the LEDs 70 mounted on the printed wiring board 68 of the display panel 52 for displaying the occupancy status of each individual seat. If the input to the AND gate 97 is low the NOR gate goes high, the vacant light is on and the occupied light is off. If the input to the AND is high, the NOR gate goes low, the vacant light is off and the occupied light is on.

Accordingly, there has been provided, in accordance with the invention, a system for indicating seat occupancy status to persons observing the seat and for displaying the seat occupancy status as well as other information pertaining to the seating area that fully satisfies the objectives set forth above. It is to be understood that all terms used herein are descriptive rather than limiting. Although the invention has been specifically described with regard to the specific embodiment set forth herein, many alternative embodiments, modifications and variations will be apparent to those skilLED in the art in light of the disclosure set forth herein. Accordingly, it is intended to include all such alternatives, embodiments, modifications and variations that fall within the spirit and scope of the invention set forth in the claims hereinbelow.

What is claimed is:

1. A seat occupancy indicator system for an assemblage of seats, comprising:

means for visually indicating seat occupancy mounted on the seat, said means for visually indicating including a plurality of LEDs each directing light in only one direction and oriented to be mutually perpendicular in order to direct light therefrom in different desired directions;

control means mounted on the seat and responsive to user occupancy thereof, said control means electrically connected to said means for visually indicating.

2. The seat indictor system of claim 1 wherein said means for visually indicating includes an LED mounted on a top portion of a seatback of the seat, said LED having an output including a color selected to facilitate recognition by a prospective user of seat occupancy status of the seat.

3. The seat indicator system of claim 1 wherein said means for visually indicating includes a manual switch electrically connected to said LED for operational control thereof and a seat sensor mounted on said seat and responsive to user occupancy of the seat, said sensor electrically connected to said LED for operational control thereof.

4. A seat occupancy indicator and area display system for use in a facility having an assemblage of seats, comprising:

a means for visually indicating seat occupancy;

means for passively determining seat occupancy connected to said means for visually indicating for activation thereof;

a manual switch for mounting on the seat, said manual switch connected to said means for visually indicating for activation thereof;

electric control circuitry electrically connected to said means for passively determining and to said manual switch;

a display panel for visually displaying seat occupancy, said display panel providing a view of the assemblage of seats, said means for visually displaying electrically connected to said electric circuitry.

5. The seat occupancy system of claim 4 wherein said display panel provides a view including the assemblage of seats and including selected artifacts in area of the assemblage of seats for providing selected information relating to the seat occupancy status and relating to the area of the assemblage.

6. The seat occupancy system of claim 4 wherein said display panel provides a realistic view of the assemblage of seats and the area thereof from a selected vantage point at area of the assemblage of seats.

7. The seat occupancy system of claim 6 wherein the selected vantage point is an entrance to the area of the assemblage of seats.

8. The seat occupancy system of claim 6 wherein the realistic view includes a holographic image.

9. The seat occupancy system of claim 8 wherein said display panel includes an edge lit hologram decal.

10. The seat occupancy system of claim 4 wherein said display panel provides a digital readout of seat availability in the assemblage of seats with real time update.

11. The seat occupancy system of claim 4 further including a viewer thermal sensor mounted on said display panel and electrically connected to said electric circuitry for activating said display panel in response to a viewer approaching said display panel.

12. The seat occupancy system of claim 4 wherein said means for visually indicating includes an LED mounted on a top portion of a seatback of the seat, said LED having an output including a color selected to facilitate recognition by a prospective user of seat occupancy status of the seat.

13. The seat occupancy system of claim 4 wherein said means for visually indicating includes a manual switch electrically connected to said LED for operational control thereof and a seat sensor mounted on said seat and responsive to user occupancy of the seat via activation thereof in response to heat or pressure produced by a user positioned on the seat, said sensor electrically connected to said LED for operational control thereof.

14. The seat occupancy system of claim 13 further including a timer connected to said manual switch for reactivating said LED to show vacancy of the seat after said manual switch has been activated for a selected period of time so that the LED shows occupancy of the seat after the selected period of time.

15. A method for indicating seat occupancy status of an assemblage of seats and displaying information related thereto, comprising:

passively determining seat occupancy, said means for passively determining having an electrical output;

providing a means for seat occupant control of said visual seat occupancy status;

visually indicating seat occupancy of said assemblage of seats in response to passive determination of seat occupancy and in response to actuation of said manual switch;

visually displaying a view of the assemblage of seats.

16. The method of claim 15 further including displaying a hologram view of the assemblage of seats and selected artifacts in area of said assemblage.

17. The method of claim 15 wherein said visually indicating seat occupancy includes utilization of selected colors.

18. A seat occupancy indicator system for an assemblage of seats, comprising:

means for visually indicating seat occupancy mounted on the seat;

control means mounted on the seat and responsive to user occupancy thereof, said control means electrically connected to said means for visually indicating;

an electrical cable for connection to an electrical power source for supplying power to said means for visually indicating and said control means, said electrical cable positioned in a conduit for carrying electrical wiring for a seat row lighting system.

19. A seat occupancy indicator system for an assemblage of seats, comprising:

means for visually indicating seat occupancy mounted on the seat;

control means mounted on the seat and responsive to user occupancy thereof, said control means electrically connected to said means for visually indicating;

a manual switch electrically connected to said means for visually indicating for operational control thereof;

a timer connected to said manual switch for reactivating said means for visually indicating to show vacancy of the seat after said manual switch has been activated for a selected period of time so that the means for visually indicating shows occupancy of the seat after the selected period of time.

20. A seat occupancy indicator and area display system for use in a facility having an assemblage of seats, comprising:

a means for visually indicating seat occupancy;

means for passively determining seat occupancy connected to said means for visually indicating for activation thereof;

a manual switch for mounting on the seat, said manual switch connected to said means for visually indicating for activation thereof;

electric control circuitry electrically connected to said means for passively determining and to said manual switch;

a display panel for visually displaying seat occupancy, said display panel electrically connected to said electric circuitry, said display panel providing a view including the assemblage of seats and including selected artifacts in area of the assemblage of seats for providing selected information relating to the seat occupancy status and relating to the area of the assemblage.

21. A seat occupancy indicator and area display system for use in a facility having an assemblage of seats, comprising:

a means for visually indicating seat occupancy;

means for passively determining seat occupancy connected to said means for visually indicating for activation thereof;

a manual switch for mounting on the seat, said manual switch connected to said means for visually indicating for activation thereof;

electric control circuitry electrically connected to said means for passively determining and to said manual switch;

a display panel for visually displaying seat occupancy, said display panel electrically connected to said electric circuitry;

an electrical cable for connection to an electrical power source, said electrical cable positioned in a conduit for carrying electrical wiring for a seat row lighting system.

22. A seat occupancy indicator and area display system for use in a facility having an assemblage of seats, comprising:

a means for visually indicating seat occupancy;

means for passively determining seat occupancy connected to said means for visually indicating for activation thereof;

a manual switch for mounting on the seat, said manual switch connected to said means for visually indicating for activation thereof;

electric control circuitry electrically connected to said means for passively determining and to said manual switch;

a display panel for visually displaying seat occupancy, said display panel electrically connected to said electric circuitry, said display panel providing a realistic view of the assemblage of seats and the area thereof from a selected vantage point at area of the assemblage of seats.

23. A seat occupancy indicator and area display system for use in a facility having an assemblage of seats, comprising:

a means for visually indicating seat occupancy;

means for passively determining seat occupancy connected to said means for visually indicating for activation thereof;

a manual switch for mounting on the seat, said manual switch connected to said means for visually indicating for activation thereof;

electric control circuitry electrically connected to said means for passively determining and to said manual switch, said electric control circuitry including logic circuitry, an enable circuit, a clock circuit, an encoder, a decoder and a transceiver;

a display panel for visually displaying seat occupancy, said means for visually displaying electrically connected to said electric circuitry.

24. A seat occupancy indicator and area display system for use in a facility having an assemblage of seats, comprising:

a means for visually indicating seat occupancy;

means for passively determining seat occupancy connected to said means for visually indicating for activation thereof;

a manual switch for mounting on the seat, said manual switch connected to said means for visually indicating for activation thereof;

electric control circuitry electrically connected to said means for passively determining and to said manual switch;

a display panel for visually displaying seat occupancy, said display panel electrically connected to said electric circuitry, said display panel providing a digital readout of seat availability in the assemblage of seats.

25. A seat occupancy indicator and area display system for use in a facility having an assemblage of seats, comprising:

a means for visually indicating seat occupancy;

means for passively determining seat occupancy connected to said means for visually indicating for activation thereof;

a manual switch for mounting on the seat, said manual switch connected to said means for visually indicating for activation thereof;

electric control circuitry electrically connected to said means for passively determining and to said manual switch;

a display panel for visually displaying seat occupancy, said display panel electrically connected to said electric circuitry;

a viewer sensor mounted on said display panel and electrically connected to said electric circuitry for activating said display panel in response to a viewer approaching said display panel.

26. A method for indicating seat occupancy status of an assemblage of seats and displaying information related thereto, comprising:

passively determining seat occupancy, said means for passively determining having an electrical output;

providing a means for seat occupant control of said visual seat occupancy status;

visually indicating seat occupancy of said assemblage of seats in response to passive determination of seat occupancy and in response to actuation of said manual switch;

displaying a view of the assemblage of seats and selected artifacts in area of said assemblage.

27. A method for indicating seat occupancy status of an assemblage of seats and displaying information related thereto, comprising:

passively determining seat occupancy, said means for passively determining having an electrical output;

providing a means for seat occupant control of said visual seat occupancy status;

visually indicating seat occupancy of said assemblage of seats in response to passive determination of seat occupancy and in response to actuation of said manual switch;

numerically displaying the seat availability.

* * * * *